US011578417B2

(12) United States Patent
Wang et al.

(10) Patent No.: US 11,578,417 B2
(45) Date of Patent: Feb. 14, 2023

(54) NANO-TWINNED CRYSTAL FILM PREPARED BY WATER/ALCOHOL-SOLUBLE ORGANIC ADDITIVES AND METHOD OF FABRICATING THE SAME

(71) Applicant: Doctech limited, Taichung (TW)

(72) Inventors: Wei-Ting Wang, Taichung (TW); Shien-Ping Feng, Taichung (TW); Yu-Ting Huang, Taichung (TW); Sheng-Jye Cherng, Taichung (TW); Chih-Chun Chung, Taichung (TW)

(73) Assignee: DOCTECH LIMITED, Taichung (TW)

( * ) Notice: Subject to any disclaimer, the term of this patent is extended or adjusted under 35 U.S.C. 154(b) by 0 days.

(21) Appl. No.: 17/135,557

(22) Filed: Dec. 28, 2020

(65) Prior Publication Data

US 2021/0198799 A1 Jul. 1, 2021

(30) Foreign Application Priority Data

Dec. 27, 2019 (TW) ..... 108148134

(51) Int. Cl.
*C25D 3/38* (2006.01)
*C25D 7/12* (2006.01)
(Continued)

(52) U.S. Cl.
CPC ..... *C25D 3/38* (2013.01); *C25D 5/617* (2020.08); *C25D 7/12* (2013.01); *H01B 5/00* (2013.01)

(58) Field of Classification Search
CPC ..... C25D 3/38–40; C25D 7/12–123; H01L 21/2885; H01L 21/76873
See application file for complete search history.

(56) References Cited

U.S. PATENT DOCUMENTS 9,476,140 B2 10/2016 Chen et al.
10,094,033 B2 10/2018 Chen et al.
(Continued)

FOREIGN PATENT DOCUMENTS

CN 1498987 A 5/2004
CN 102318041 A 1/2012
(Continued)

OTHER PUBLICATIONS

Jin et al., Machine Translation, CN-102400188-A. (Year: 2012).*
Cheng et al., Extra strengthening and work hardening in gradient nanotwinned metals, Science 362 (Year: 2018).*

*Primary Examiner* — Ho-Sung Chung
(74) *Attorney, Agent, or Firm* — Birch, Stewart, Kolasch & Birch, LLP

(57) ABSTRACT

A nano-twinned crystal film and a method thereof are disclosed. The method of fabricating a nano-twinned crystal film includes utilizing an electrolyte solution including copper salt, acid, and a water or alcohol-soluble organic additive, and performing electrodeposition, under conditions of a current density of 20~100 mA/cm$^2$, a voltage of 0.2~1.0V, and a cathode-anode distance of 10~300 mm, to form the nano-twinned crystal film on a surface at the cathode. The nano-twinned crystal film formed by the method includes a plurality of nano-twinned copper grains and a region of random crystal phases between some of adjacent nano-twinned copper grains, wherein at least some of the nano-twinned copper grains have a pillar cap configuration with a wide top and a narrow bottom.

9 Claims, 7 Drawing Sheets

(51) Int. Cl.
*H01B 5/00* (2006.01)
*C25D 5/00* (2006.01)

(56) References Cited

U.S. PATENT DOCUMENTS

| | | | | |
|---|---|---|---|---|
| 2005/0081744 | A1* | 4/2005 | Klocke | C25D 3/38 205/291 |
| 2010/0206737 | A1 | 8/2010 | Preisser | |
| 2014/0090880 | A1 | 4/2014 | Chen et al. | |
| 2015/0064496 | A1* | 3/2015 | Chen | C30B 19/103 428/641 |
| 2016/0355940 | A1 | 12/2016 | Chen et al. | |
| 2022/0010446 | A1* | 1/2022 | Banik, II | C25D 5/611 |

FOREIGN PATENT DOCUMENTS

| | | | | |
|---|---|---|---|---|
| CN | 102400188 | A | * | 4/2012 |
| CN | 106350836 | A | | 1/2017 |
| TW | 201321557 | A1 | | 6/2013 |
| TW | 201415563 | A | | 4/2014 |

* cited by examiner

NANO-TWINNED CRYSTAL FILM PREPARED BY WATER/ALCOHOL-SOLUBLE ORGANIC ADDITIVES AND METHOD OF FABRICATING THE SAME

BACKGROUND OF THE INVENTION

1. Field of the Invention

The invention generally relates to a nano-twinned crystal film and a method of fabricating the same. Particularly, the invention relates to a nano-twinned copper film prepared by water/alcohol-soluble organic additives and a method of fabricating the same.

2. Description of the Prior Art

Copper is widely used in electric power, chemical industry, aerospace, and other fields and plays an important role in human life and work because of its good thermal conductivity, electrical conductivity, corrosion resistance, and malleability.

Coarse crystal copper has great deformability but less strength, so conventional techniques add trace elements to form copper alloy to enhance the hardness and strength, but greatly decrease the conductivity and restrict the applications in electric power. In addition, the adding of small amount of iron or nickel will change the magnetic properties of copper, which is not conducive to the manufacture of magnetically sensitive devices, such as compasses. Because copper is a soft, malleable, and ductile metal, copper is often used for electrical welding of components, and high-temperature reflow treatment is required during processing, so intermetallic compounds and voids are easily formed on the interface, impairing the function of the components and reducing the electro-migration resistance.

Several approaches of modifying the crystal configuration of coper have been developed to address the above drawbacks of copper and copper alloy. Among them, the formation of nano-twinned copper films by electroplating is a solution that has attracted much attention. For example, CN 1498987A discloses a bulk nano-twinned copper material prepared by electrodeposition technique, and the nano-twinned copper material has a grain size of 30 nm, a yield strength of 119 MPa at room temperature, and an electric conductivity up to 90% or more of the coarse crystal pure copper. When the nano crystal copper sample is further processed at room temperature, the tensile yield strength is increased up to 535 MPa, which is significantly higher than 0.035 GPa of coarse crystal pure copper. TW 201415563A utilizes the nano-twinned copper to reduce the occurrence of voids and to promote the electro-migration resistance. However, in the preparation of the nano-twinned copper film, gelatin is the only listed additive, limiting the applications no matter for scientific research or industry production. Moreover, the copper film has to be physically processed to improve the physical properties, increasing the production cost of copper film.

SUMMARY OF THE INVENTION

It is an aspect of the invention to provide a nano-twinned crystal copper film and a method of fabricating the same, which utilizes water/alcohol soluble organic additives and obtains microstructures of the nano-twinned copper grains of different configurations by adjusting the content of the water/alcohol soluble organic additives.

In an embodiment, the invention provides a method of fabricating a nano-twinned crystal film including utilizing an electrolyte solution including copper salt, acid, and a water-soluble or alcohol-soluble organic additive, and performing electrodeposition, under conditions of a current density of 20~100 mA/cm$^2$, a voltage of 0.2~1.0V, and a cathode-anode distance of 10~300 mm, to form the nano-twinned crystal film on a surface at the cathode.

In an embodiment, the water-soluble or alcohol-soluble organic additive is selected from a group consisting of Dexamethasone, Hydrocortisone, starch, Gum Arabic, Glucose, Fructose, galactose, Polysaccharide, Sucrose, Maltose, Lactose, Oligosaccharide, Cellulose, Carboxymethyl Cellulose, Carboxyethyl Cellulose, Carboxypropyl Cellulose, Methyl Cellulose, Hydroxymethyl Cellulose, Hydroxyethyl Cellulose, Hydroxypropyl Cellulose, Ethyl Cellulose, Propyl Cellulose, pectin, Glyceraldehyde, Dihydroxyacetone, Glycerol, Chitin, Hemicellulose, Xylose, Arabinose, Mannose, Lignin, poly(oxyethylene), Polyethylenimine, Polyphenylene oxide, Polyethylene glycol, Poly(acrylic acid), Polyacrylamide, Polyvinyl alcohol, Polystyrene sulfonate, Dioctyldimethylammonium bromide, Polypropylene glycol, Polytetrahydrofuran, poly(sodium styrenesulfonate), ethylene glycol, Bis-(sodium sulfopropyl)-disulfide, Didecyldimethylammonium chloride, Didodecyldimethylammonium chloride, Ditetradecyldimethylammonium bromide, Dihexadecyldimethylammonium bromide, Dioctadecyldimethylammonium chloride, Dodecyltrimethylammonium chloride, Tetradecyltrimethylammonium chloride, Hexadecyltrimethylammonium chloride, Octadecyltrimethylammonium chloride, Dodecylbenzyldimethylammonium chloride, and a combination thereof.

In an embodiment, the acid in the electrolyte solution is sulfuric acid, hydrochloric acid, phosphoric acid, methanesulfonic acid, sulfonic acid, or a mixture thereof.

In an embodiment, the surface can be a surface of a silicon substrate, a titanium substrate, an iron substrate, a nickel substrate, a copper substrate, or a substrate surface having a [111] crystal orientation.

In an embodiment, the copper salt is copper sulfate, and a concentration of the copper salt in the electrolyte solution is 0.3 mol/L or more.

In an embodiment, the water-soluble or alcohol-soluble organic additive is in an amount of 0.0001 g/L or more.

In an embodiment, the water-soluble or alcohol-soluble organic additive is in the amount of 0.0001 g/L to 0.1 g/L.

In an embodiment, the method of fabricating the nano-twinned crystal film can be applied to a through-silicon via (TSV), an interconnect of a semiconductor chip, a pin through hole of a package substrate, a metal wire, or a trace in a substrate.

In another embodiment, the invention provides a nano-twinned crystal film formed by the method described above. The nano-twinned crystal film includes a plurality of nano-twinned copper grains and a region of random crystal phases between some of adjacent nano-twinned copper grains, wherein at least some of the nano-twinned copper grains have a pillar cap configuration with a wide top and a narrow bottom.

In an embodiment, the region of random crystal phases includes nano-twinned coppers of different inclined angles, polycrystalline copper, or a combination thereof.

In an embodiment, the plurality of nano-twinned copper grains are arranged in a truss structure.

In an embodiment, the nano-twinned crystal film has a layered thickness of 5 to 500 nanometers.

In an embodiment, the plurality of nano-twinned copper grains has a characteristic peak at [111] orientation.

In an embodiment, the nano-twinned crystal film can be applied to a through-silicon via, an interconnect of a semiconductor chip, a pin through hole of a package substrate, a metal wire, or a trace in a substrate.

Compared to the prior art, the invention develops the use of water/alcohol-soluble organic additives for the preparation of nano-twinned copper film, which broadens the usability of additives, reduces the difficulty and cost of preparation of nano-twinned copper film, and greatly improves the practicability. Moreover, the nano-twinned copper film of the invention can be obtained in different configurations of nano-twinned copper grains by modifying the content of the water/alcohol-soluble organic additive in the electrolyte solution, so as to derive a series of nano-twinned copper grains having different physical properties, which improves the feasibility of various application developments and reduces the fabrication cost.

DETAILED DESCRIPTION OF THE PREFERRED EMBODIMENT

Figure 1:
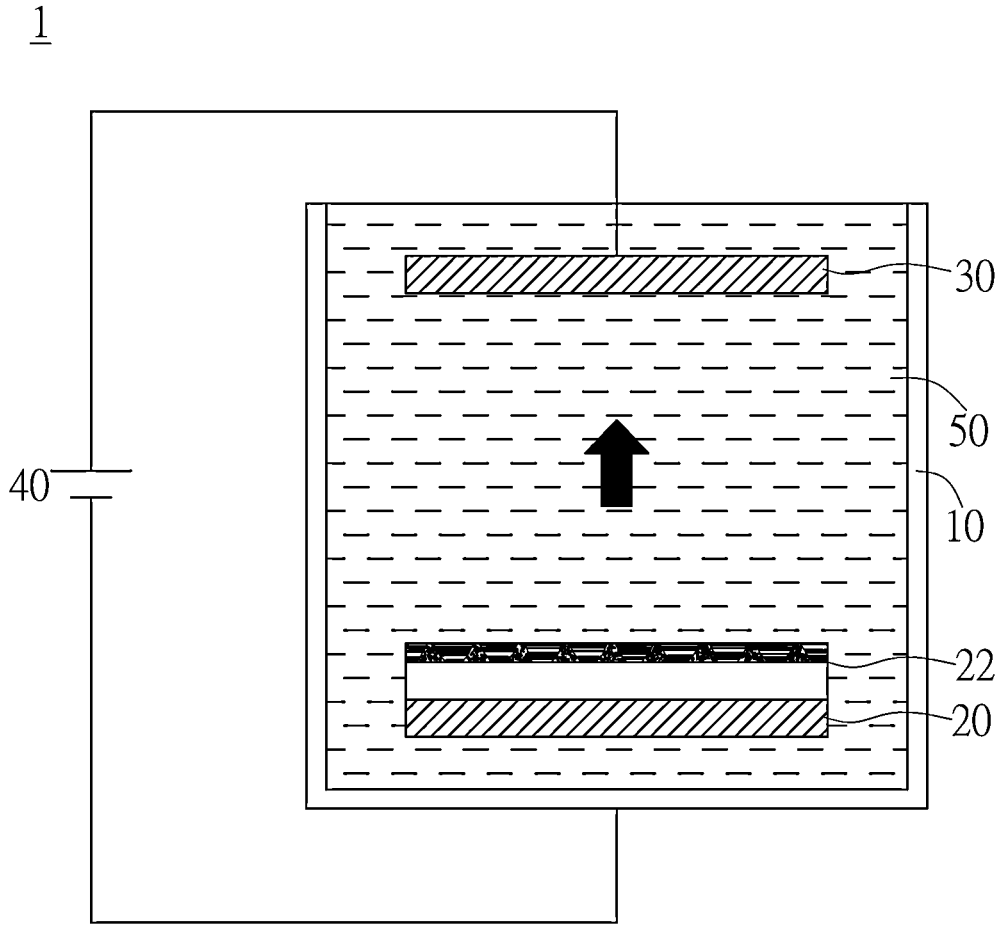
FIG. 1 is a schematic view of the electrodeposition device for fabricating the nano-twinned crystal film of the invention.

In the drawings, the thickness of layers, films, panels, regions, etc., are exaggerated for clarity. Like reference numerals designate like elements throughout the specification. It will be understood that when an element such as a layer, film, region, or substrate is referred to as being "on" or "connected to" another element, it can be directly on or connected to the other element or intervening elements may also be present. In contrast, when an element is referred to as being "directly on" or "directly connected to" another element, there are no intervening elements present.

In addition, the relative terms such as "below" or "bottom" and "above" or "top" may be used herein to describe the relationship of one element to another, as illustrated. It will be understood that the relative terms are intended to encompass different orientations of the device in addition to the orientation shown in the drawings. For example, if the device in the drawings is turned over, the elements described as being "below" the other elements will be oriented on the "upper" side of the other elements. Therefore, the exemplary term "below" may encompass the orientation of "below" and "above" depending on the particular orientation of the drawing. Similarly, if the device in the drawings is turned over, the elements described as being "above" the other elements will be oriented on the "lower" side of the other elements. Therefore, the exemplary term "above" may encompass the orientation of "above" and "below" depending on the particular orientation of the drawing.

"About", "approximately" or "substantially" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, ±20%, ±10%, ±5% of the stated value. Moreover, "about", "approximately" or "substantially" as used herein may select a more acceptable range of deviation or standard deviation depending on optical properties, etching properties, or other properties, without applying a standard deviation for all properties.

In an embodiment, the invention provides a method of fabricating a nano-twinned crystal film, which includes: utilizing an electrolyte solution including copper salt, acid, and a water-soluble or alcohol-soluble organic additive, and performing electrodeposition to form the nano-twinned crystal film on a surface at the cathode. FIG. 1 is a schematic view of the electrodeposition device for fabricating the nano-twinned crystal film of the invention. As shown in FIG. 1, the electrodeposition device 1 includes an electrolytic tank 10, a cathode 20, an anode 30, and a power supply source 40. The cathode 20 and the anode 30 are space apart in the electrolytic tank 10, and the power supply source 40 is connected to the cathode 20 and the anode 30 and configured to supply power for electrodeposition. In an embodiment, the anode 30 is preferably a copper plate, which has a purity of 99.99%, but not limited thereto. In another, the anode 30 can be made of any suitable materials, such as phosphorus copper. The surface 22 at the cathode 20 can be any suitable surface, on which the copper film is to be plated thereon, such as semiconductor surface in the semiconductor process (e.g. surface of silicon wafer), metal surface (e.g. surface of titanium, iron, nickel, or copper substrate), surface of metal layer or seed layer on non-metal substrate (e.g. glass, quartz or plastic substrate, or printed circuit board), or substrate surface having [111] crystal orientation. The electrolyte solution 50 is received in the electrolytic tank 10 in a manner that the cathode 20 and the anode 30 are immersed in the electrolyte solution 50.

In an embodiment, the acid in the electrolyte solution 50 can be sulfuric acid, hydrochloric acid, phosphoric acid, methanesulfonic acid, sulfonic acid, or a mixture thereof. The copper salt in the electrolyte solution 50 preferably includes copper sulfate, and the concentration of the copper salt in the electrolyte solution 50 is 0.3 mol/L or more. The water-soluble or alcohol-soluble organic additive in the electrolyte solution 50 can be selected from a group consisting of Dexamethasone, Hydrocortisone, starch, Gum Arabic, Glucose, Fructose, galactose, Polysaccharide, Sucrose, Maltose, Lactose, Oligosaccharide, Cellulose, Carboxymethyl Cellulose, Carboxyethyl Cellulose, Carboxypropyl Cellulose, Methyl Cellulose, Hydroxymethyl Cellulose, Hydroxyethyl Cellulose, Hydroxypropyl Cellulose, Ethyl Cellulose, Propyl Cellulose, pectin, Glyceraldehyde, Dihydroxyacetone, Glycerol, Chitin, Hemicellulose, Xylose, Arabinose, Mannose, Lignin, poly(oxyethylene), Polyethylenimine, Polyphenylene oxide, Polyethylene glycol, Poly(acrylic acid), Polyacrylamide, Polyvinyl alcohol, Polystyrene sulfonate, Dioctyldimethylammonium bromide, Polypropylene glycol, Polytetrahydrofuran, poly(sodium styrenesulfonate), ethylene glycol, Bis-(sodium sulfopropyl)-disulfide, Didecyldimethylammonium chloride, Didodecyldimethylammonium chloride, Ditetradecyldimethylammonium bromide, Dihexadecyldimethylammonium bromide, Dioctadecyldimethylammonium chloride, Dodecyltrimethylammonium chloride, Tetradecyltrimethylammonium chloride, Hexadecyltrimethylammonium chloride, Octadecyltrimethylammonium chloride, Dodecylbenzyldimethylammonium chloride, and a combination thereof.

The water-soluble or alcohol-soluble organic additive is preferably in an amount of 0.0001 g/L or more, and more preferably in the amount of 0.0001 g/L to 0.1 g/L, but not limited thereto. According to practical applications, the content of water-soluble or alcohol-soluble organic additive in the electrolyte solution 50 can be modified to obtain the microstructure of nano-twinned copper crystal grains in the desired configuration. For example, the content of water-soluble or alcohol-soluble organic additive can be 0.1 g/L or more.

Moreover, the electrodeposition can be performed, for example, under conditions of a current density of 20~100 mA/cm$^2$, a voltage of 0.2~1.0V, a cathode-anode distance of 10~300 mm, and an electrolyte temperature of 15~30° C. Hereinafter, embodiments of the method of fabricating the nano-twinned crystal film will be described in detail.

Embodiment 1

In the embodiment, the electrolyte solution is aqueous copper sulfate solution, which includes copper sulfate crystals, deionized water, and sulfuric acid, and the concentration of the copper salt in the electrolyte solution is 0.3 mol/L. The water-soluble or alcohol-soluble organic additive is in the amount of 0.0001 g/L to 0.1 g/L, such as 0.0001 g/L, and contains one or more compounds selected from the group of organic additives described above. The electrodeposition conditions include the current density of 20~100 mA/cm$^2$, the voltage of 0.2~1.0V, the cathode-anode distance of 10~300 mm, and the electrolyte temperature of 25~28° C. The anode is a 99.99% pure copper plate, and the surface at the cathode is a silicon wafer prepared for copper deposition. The nano-twinned crystal film fabricated according to Embodiment 1 can be referred to FIG. 2A and FIG. 2B.

Figure 2A:
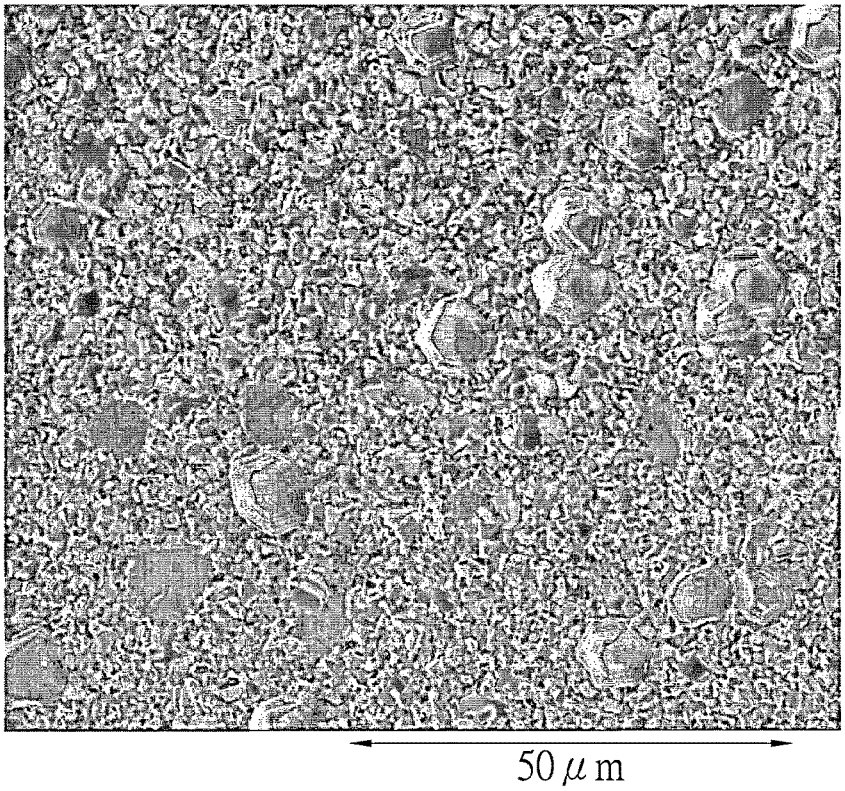
FIG. 2A is a superficial scanning electron microscope (SEM) photo of the nano-twinned crystal film in an embodiment of the invention.
Figure 2B:
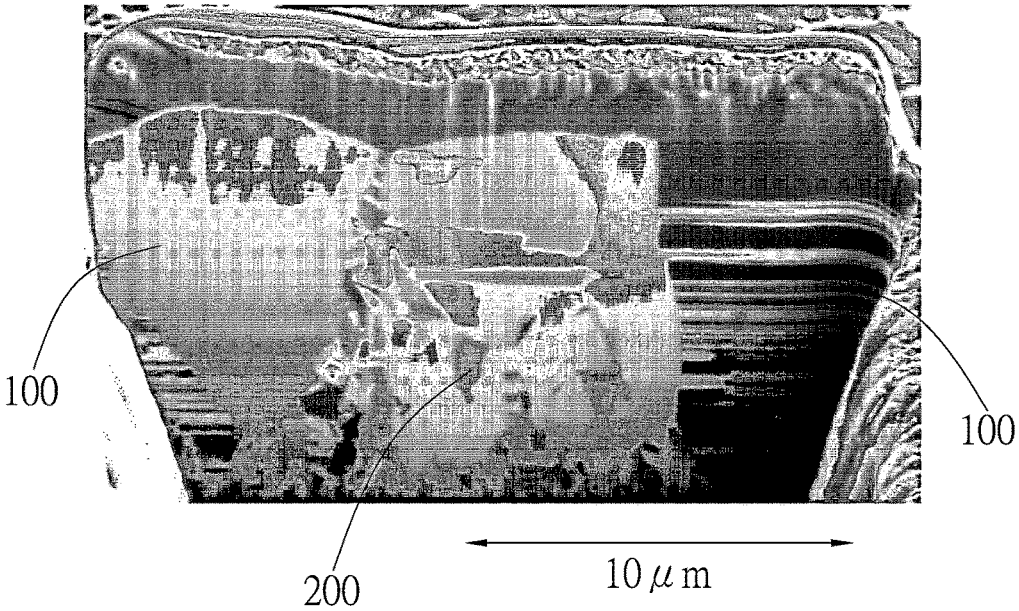
FIG. 2B is a cross-sectional focused ion beam (FIB) photo of the nano-twinned crystal film in an embodiment of the invention.
Figure 3:
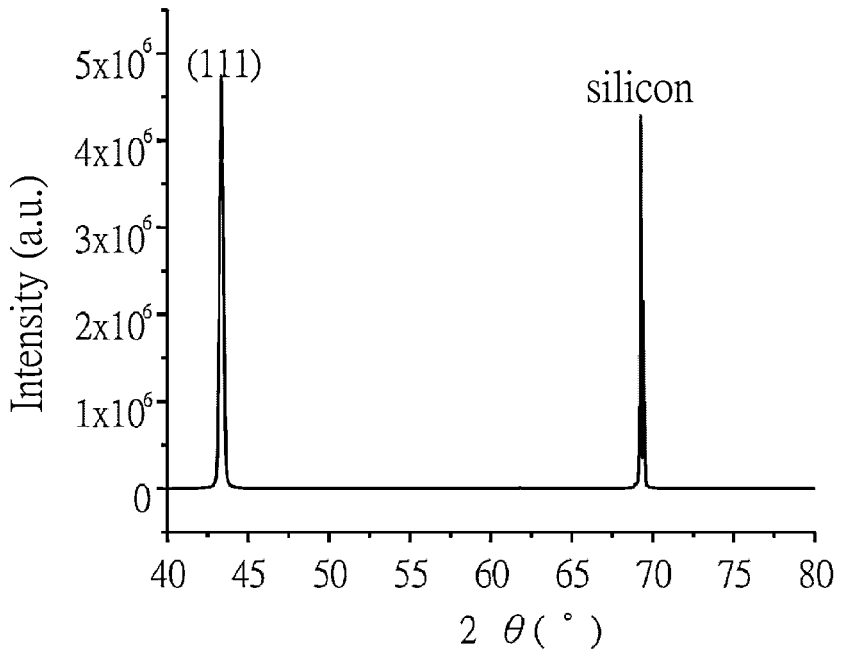
FIG. 3 is an X-ray diffraction (XRD) diagram of the nano-twinned crystal film in an embodiment of the invention.

FIG. 2A and FIG. 2B are a superficial SEM photo and a cross-sectional FIB photo of the nano-twinned crystal film, respectively. As shown in FIG. 2A and FIG. 2B, the nano-twinned crystal film fabricated according to Embodiment 1 includes a plurality of nano-twinned copper grains 100 and a region of random crystal phases 200 between some of adjacent nano-twinned copper grains 100, wherein at least some of the nano-twinned copper grains have a pillar cap configuration with a wide top and a narrow bottom. Specifically, the plurality of nano-twinned copper grains 100 having the pillar cap configuration of wide top and narrow bottom are arranged in a truss structure, such as Warren truss. In other words, the nano-twinned copper grains 100 have a reversed triangle-like cross section with the region of random crystal phases 200 therebetween. In an embodiment, the region of random crystal phases 200 includes nano-twinned coppers of different inclined angles, polycrystalline copper, or a combination thereof. The nano-twinned crystal film has a layered thickness of 5 to 500 nanometers. As shown in FIG. 3, the nano-twinned copper grain has a characteristic peak at [111] orientation, i.e., the copper grain has a preferred orientation of [111] crystal axis.

Embodiment 2

Figure 4A:
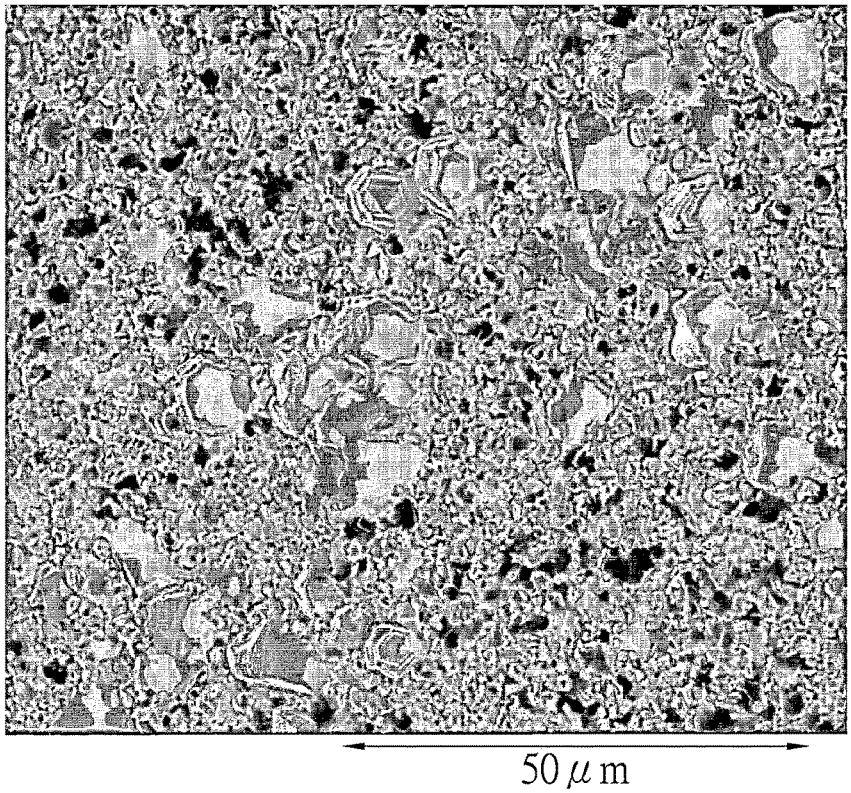
FIG. 4A is a superficial SEM photo of the nano-twinned crystal film in another embodiment of the invention.
Figure 4B:
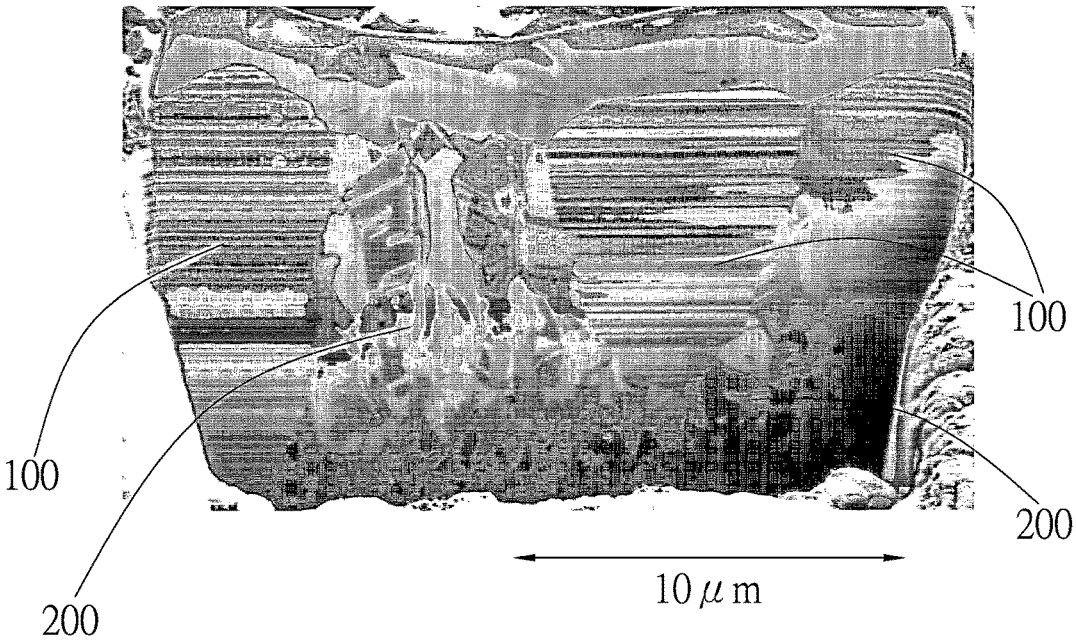
FIG. 4B is a cross-sectional FIB photo of the nano-twinned crystal film in another embodiment of the invention.

Embodiment 2 is different from Embodiment 1 in the content of the water-soluble or alcohol-soluble organic additive. Specifically, in embodiment 2, the water-soluble or alcohol-soluble organic additive is in the amount of 0.0001 g/L to 0.1 g/L, but different from Embodiment 1, such as 0.1 g/L. The nano-twinned crystal film fabricated according to Embodiment 2 can be referred to FIG. 4A and FIG. 4B. FIG. 4A and FIG. 4B are a superficial SEM photo and a cross-sectional FIB photo of the nano-twinned crystal film, respectively. As shown in FIG. 4A and FIG. 4B, the nano-twinned copper grains 100 in the nano-twinned crystal film have a different configuration by modifying the content of the water-soluble or alcohol-soluble organic additive. In this embodiment, the nano-twinned copper grains 100 are arranged denser than and the nano-twinned copper grains 100 of FIG. 2B. The regions of random crystal phases 200 of different sizes are arranged between adjacent nano-twinned copper grains 100. Similarly, the region of random crystal phases 200 includes nano-twinned coppers of different inclined angles, polycrystalline copper, or a combination thereof. The nano-twinned crystal film has a layered thickness of 5 to 500 nanometers, and the nano-twinned copper grain 100 has a characteristic peak at [111] orientation.

It can be seen from Embodiment 1 and Embodiment 2 that the nano-twinned copper grains of different configurations can be obtained by modifying the content (or composition) of the water-soluble or alcohol-soluble organic additives. In FIG. 2B, the plurality of nano-twinned copper grains 100 and the region of random crystal phases 200 are arranged in a clear truss structure with a wide top and a narrow bottom. In FIG. 4B, the regions of random crystal phases 200 are interposed between some of the plurality of nano-twinned copper grains 100, making the arrangement of the plurality of nano-twinned copper grains 100 much denser.

Figure 5:
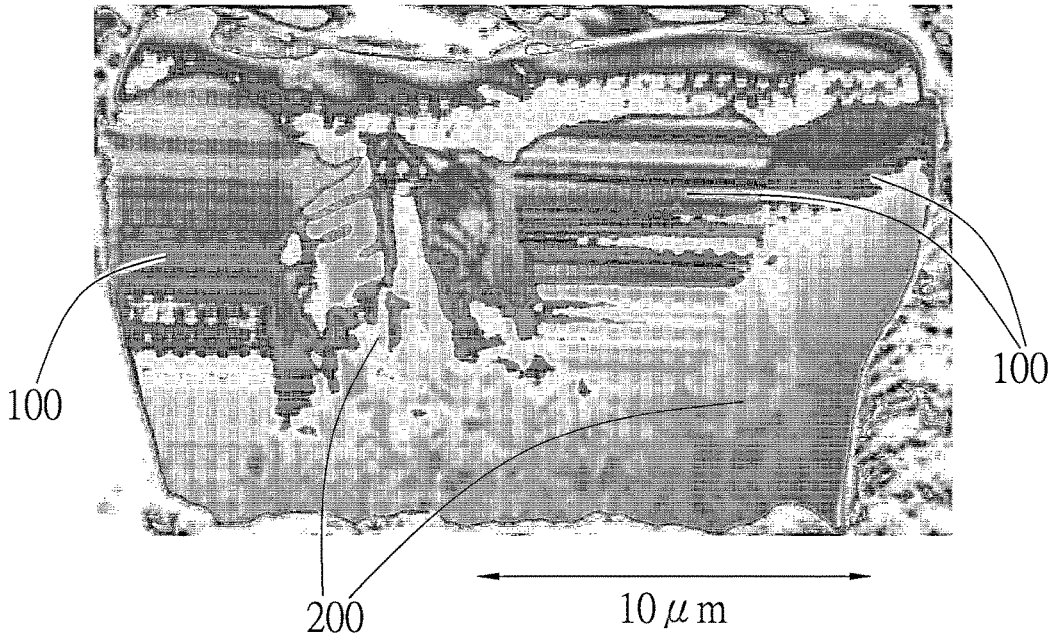
FIG. 5 is a cross-sectional FIB photo of the nano-twinned crystal film fabricated after 20 days in an embodiment of the invention.

Furthermore, FIG. 5 is a cross-sectional FIB photo of the nano-twinned crystal film fabricated after 20 days in an embodiment (e.g. Embodiment 2) of the invention. As shown in FIG. 5, it can be seen from the observation of the nano-twinned crystal film fabricated after 20 days that no significant change occurs in the microscopic grain structure of the plurality of nano-twinned copper grains 100 and the regions of random crystal phases 200 therebetween, indicating that the nano-twinned crystal film fabricated by the method of the invention has high structural stability.

Embodiment 3

Figure 6:
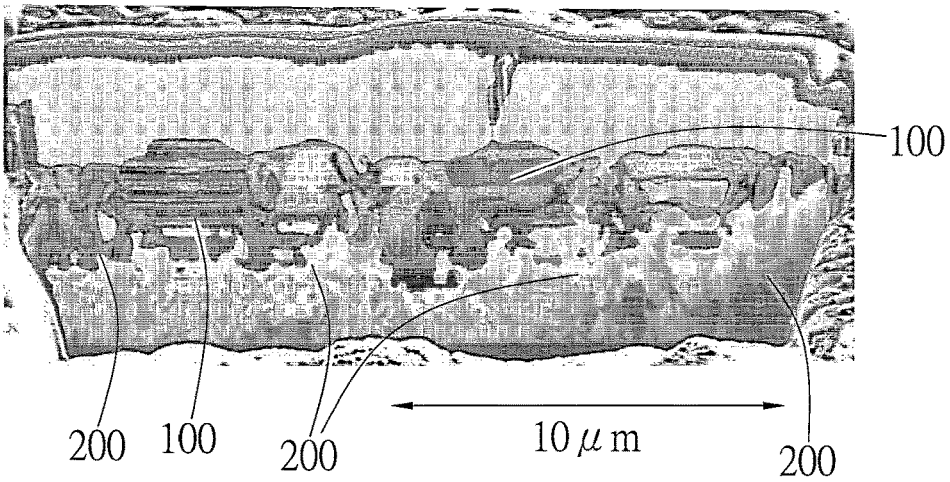
FIG. 6 is a cross-sectional FIB photo of the nano-twinned crystal film in yet another embodiment of the invention.

Embodiment 3 is different from Embodiment 1 and Embodiment 2 in the content of the water-soluble or alcohol-soluble organic additives. Specifically, in Embodiment 3, the water-soluble or alcohol-soluble organic additive is in the amount larger than 0.1 g/L. The nano-twinned crystal film fabricated according to Embodiment 3 can be referred to FIG. 6. As shown in FIG. 6, when using the water-soluble or alcohol-soluble organic additive in an amount larger than 0.1 g/L, the number of the nano-twinned copper grains 100 in the nano-twinned crystal film is significantly reduced.

Comparative Embodiment

Figure 7:
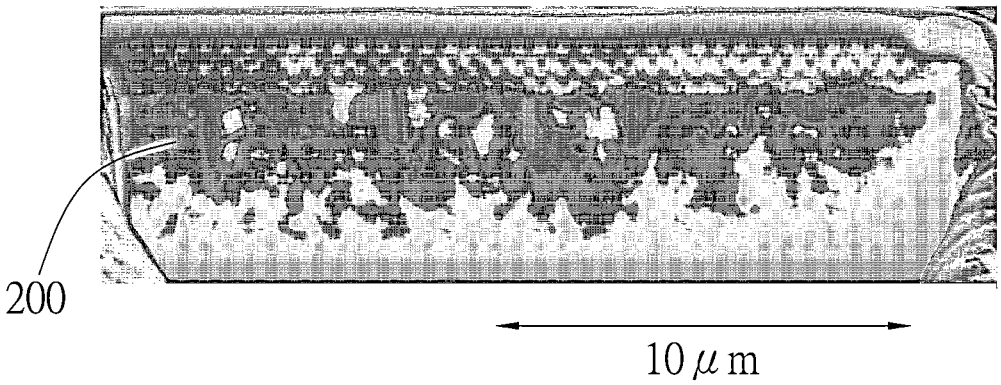
FIG. 7 is a cross-sectional FIB photo of the nano-twinned crystal film in a comparative embodiment.

Comparative Embodiment is different from Embodiment 1 in that no water-soluble or alcohol-soluble organic additives is used. FIG. 7 is a cross-sectional FIB photo of the nano-twinned crystal film of Comparative Embodiment. As shown in FIG. 7, when the electrolyte solution contains no water-soluble or alcohol-soluble organic additives, no nano-twinned copper grains is formed.

Embodiment 4

Figure 8:
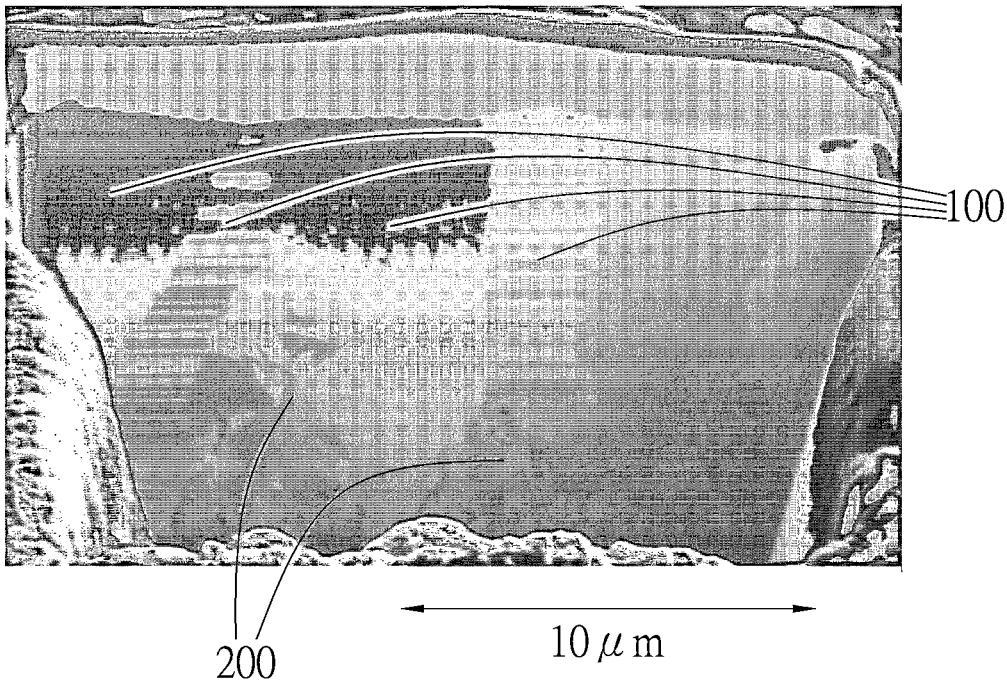
FIG. 8 is a cross-sectional FIB photo of the nano-twinned crystal film in a further embodiment of the invention.

FIG. 8 is a cross-sectional FIB photo of the nano-twinned crystal film fabricated in Embodiment 4. In Embodiment 4, the electrolyte solution is aqueous copper sulfate solution, which includes copper sulfate crystals, deionized water, and sulfuric acid, and the concentration of the copper sulfate in the electrolyte solution is 0.3 mol/L. The water-soluble or alcohol-soluble organic additive is in the amount of 0.0001 g/L to 0.1 g/L, such as 0.0001 g/L, and contains one or more compounds selected from the group of organic additives described above, but different from the water-soluble or alcohol-soluble organic additive used in Embodiment 1. The electrodeposition conditions include the current density of 20~100 mA/cm$^2$, the voltage of 0.2~1.0V, the cathode-anode distance of 10~300 mm, and the electrolyte temperature of 25~28° C. The anode is a 99.99% pure copper plate, and the surface at the cathode is a silicon wafer prepared for copper deposition. As shown in FIG. 8, the nano-twinned crystal film fabricated according to Embodiment 4 includes a plurality of nano-twinned copper grains 100 and a region of random crystal phases 200 between some of adjacent nano-twinned copper grains 100, wherein at least some of the nano-twinned copper grains 100 have a pillar cap configuration with a wide top and a narrow bottom. Specifically, at least some of the plurality of nano-twinned copper grains 100 in Embodiment 4 have a reversed triangle-like cross section and are arranged in a truss structure similar to Embodiment 1 with the regions of random crystal phases 200 interposed therebetween. In an embodiment, the region of random crystal phases 200 includes nano-twinned coppers of different inclined angles, polycrystalline copper, or a combination thereof. The nano-twinned crystal film has a layered thickness of 5 to 500 nanometers. As shown in FIG. 8, by selecting the water-soluble or alcohol-soluble organic additive different from Embodiment 1, the nano-twinned crystal film can have similar nano-twinned copper grains, and the regions of random crystal phases 200 are reduced.

Figure 9:
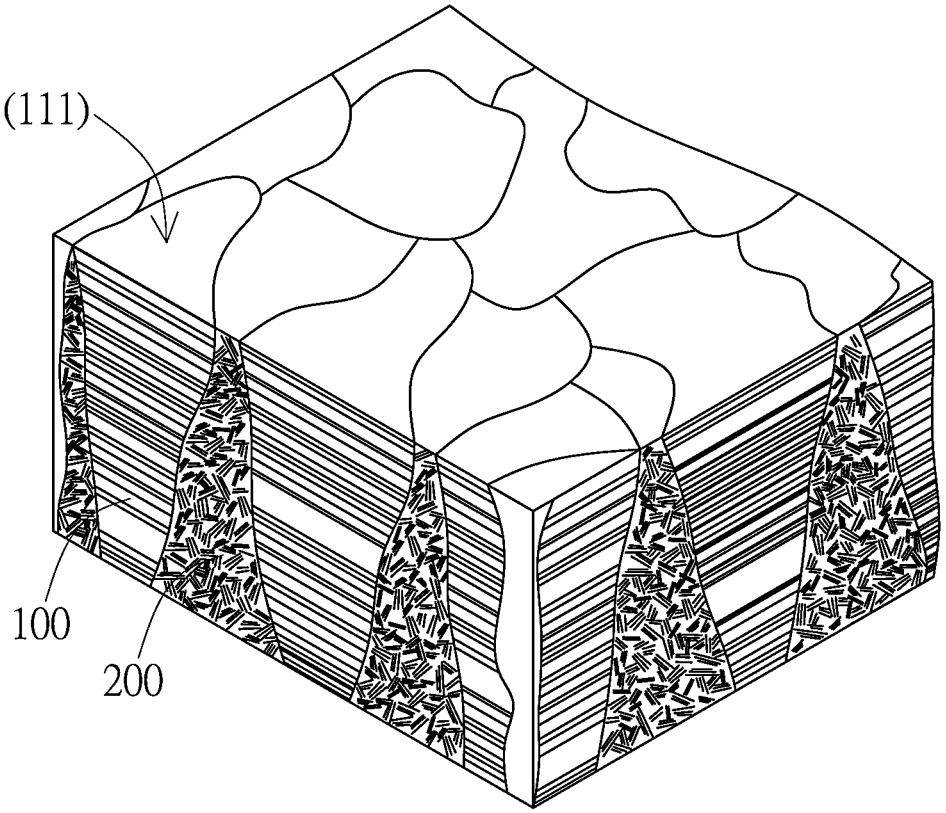
FIG. 9 is an isometric representation of the nano-twinned crystal film of the invention.

Specifically, as shown in FIG. 9, in another embodiment, the invention provides a nano-twinned crystal film fabricated by the method described above. The nano-twinned crystal film includes a plurality of nano-twinned copper grains 100 and a region of random crystal phases 200 between some of adjacent nano-twinned copper grains 100. At least some of the nano-twinned copper grains 100 have a pillar cap configuration with a wide top and a narrow bottom. In an embodiment, the region of random crystal phases 200 includes nano-twinned coppers of different inclined angles, polycrystalline copper, or a combination thereof. The plurality of nano-twinned copper grains 100 are arranged in a truss structure, such as Warren truss. The nano-twinned crystal film has a layered thickness of 5 to 500 nanometers, and the nano-twinned copper grain has a characteristic peak at [111] orientation.

Moreover, the nano-twinned crystal film can be applied to a through-silicon via (TSV), an interconnect of a semiconductor chip, a pin through hole of a package substrate, a metal wire, or a trace in a substrate, so that the nano-twinned crystal film can serve as a conductive layer having excellent mechanical properties and electro-migration resistance.

Compared to the prior art, the method of fabricating a nano-twinned crystal film of the invention utilizes the water-soluble or alcohol-soluble organic additive to broaden the usability of additives, reduce the difficulty and cost of fabricating the nano-twinned copper film, and greatly improve the practicability. Moreover, the nano-twinned copper film of the invention can be obtained in different configurations of nano-twinned copper grains by modifying the content of the water-soluble or alcohol-soluble organic additive in the electrolyte solution, so as to derive a series of nano-twinned copper grains having different physical properties, which improves the feasibility of various application developments and reduces the fabrication cost.

Although the preferred embodiments of the invention have been described herein, the above description is merely illustrative. The preferred embodiments disclosed will not limit the scope of the invention. Further modification of the invention herein disclosed will occur to those skilled in the respective arts and all such modifications are deemed to be within the scope of the invention as defined by the appended claims.

What is claimed is:

1. A method of fabricating a nano-twinned crystal film, comprising:

utilizing an electrolyte solution including copper salt, acid, and a water-soluble or alcohol-soluble organic additive;

adjusting a content of the water-soluble or alcohol-soluble organic additive; and performing an electrodeposition process, under conditions of a current density of 20-100 mA/cm$^2$, a voltage of 0.2-1.0 V, and a cathode-anode distance of 10-300 mm, to form the nano-twinned crystal film on a surface of the cathode, wherein the nano-twinned crystal film has a plurality of nano-twinned copper grains, and at least some of the nano-twinned copper grains have a pillar cap configuration with a wide top and a narrow bottom and are arranged in a truss structure with a region of random crystal phases between the at least some of the nano-twinned copper grains.

2. The method of claim 1, wherein the acid in the electrolyte solution is sulfuric acid, hydrochloric acid, phosphoric acid, methanesulfonic acid, sulfonic acid, or a mixture thereof.

3. The method of claim 1, wherein the surface is a surface of a silicon substrate, a titanium substrate, an iron substrate, a nickel substrate, a copper substrate, or a substrate surface having a [111] crystal orientation.

4. The method of claim 1, wherein the copper salt is copper sulfate, and a concentration of the copper salt in the electrolyte solution is in a range between 0.1 mol/L and 1 mol/L.

5. The method of claim 1, wherein the water-soluble or alcohol-soluble organic additive is in an amount of 0.0001 g/L to 0.1 g/L.

6. The method of claim 1, wherein the nano-twinned crystal film is formed in a through-silicon via, an interconnect of a semiconductor chip, a pin through hole of a package substrate, a metal wire, or a trace in a substrate.

7. The method of claim 1, wherein the region of random crystal phases includes nano-twinned coppers of different inclined angles, polycrystalline copper, or a combination thereof.

8. The method of claim 1, wherein the water-soluble or alcohol-soluble organic additive is selected from a group consisting of Dexamethasone, Hydrocortisone, starch, Gum Arabic, Glucose, Fructose, galactose, Polysaccharide, Sucrose, Maltose, Lactose, Oligosaccharide, Cellulose, Carboxymethyl Cellulose, Carboxyethyl Cellulose, Carboxypropyl Cellulose, Methyl Cellulose, Hydroxymethyl Cellulose, Hydroxyethyl Cellulose, Hydroxypropyl Cellulose, Ethyl Cellulose, Propyl Cellulose, pectin, Glyceraldehyde, Dihydroxyacetone, Glycerol, Chitin, Hemicellulose, Xylose, Arabinose, Mannose, Lignin, poly(oxyethylene), Polyethylenimine, Polyphenylene oxide, Polyethylene glycol, Poly(acrylic acid), Polyacrylamide, Polyvinyl alcohol, Polystyrene sulfonate, Dioctyldimethylammonium bromide, Polypropylene glycol, Polytetrahydrofuran, poly(sodium styrenesulfonate), ethylene glycol, Bis-(sodium sulfopropyl)-di sulfide, Didecyldimethylammonium chloride, Didodecyldimethylammonium chloride, Ditetradecyldimethylammonium bromide, Dihexadecyldimethylammonium bromide, Dioctadecyldimethylammonium chloride, Dodecyltrimethylammonium chloride, Tetradecyltrimethylammonium chloride, Hexadecyltrimethylammonium chloride, Octadecyltrimethylammonium chloride, Dodecylbenzyldimethylammonium chloride, and a combination thereof.

9. The method of claim 8, wherein the water-soluble or alcohol-soluble organic additive is in an amount of 0.0001 g/L to 0.1 g/L.

* * * * *